US005727441A

United States Patent [19]

Fu et al.

[11] Patent Number: 5,727,441

[45] Date of Patent: Mar. 17, 1998

[54] VALVE PLATE STRUCTURE OF AN AXIAL PLUNGER PUMP

[75] Inventors: Chiun Lern Fu, Hsinchu; Jiun-Jeng Chen, Miauli; Chaur-Chyn Luoh, Taipei; Chen-Der Tsai, Hsinchu, all of Taiwan

[73] Assignee: Industrial Technology Research Institute, Hsinchu, Taiwan

[21] Appl. No.: 376,271

[22] Filed: Jan. 20, 1995

[51] Int. Cl.[6] ..... F04B 13/04

[52] U.S. Cl. ..... 91/6.5

[58] Field of Search ..... 417/269; 91/474, 91/487, 6.5

[56] References Cited

U.S. PATENT DOCUMENTS

| | | | |
|---|---|---|---|
| 3,199,461 | 8/1965 | Wolf | 91/6.5 |
| 4,048,903 | 9/1977 | Roberts | 91/6.5 |
| 4,489,642 | 12/1984 | Westveer | 91/6.5 |
| 4,540,345 | 9/1985 | Frazer | 417/269 |
| 4,757,743 | 7/1988 | Tovey | 91/6.5 |

FOREIGN PATENT DOCUMENTS

| | | | |
|---|---|---|---|
| 684551 | 12/1952 | United Kingdom | 91/487 |

OTHER PUBLICATIONS

Shigley, Joseph, *Mechanical Engineering Design*, McGraw-Hill, ©1977.

*Primary Examiner*—Richard E. Gluck
*Attorney, Agent, or Firm*—W. Wayne Liauh

[57] ABSTRACT

An improved valve plate structure for use in axial plunger pumps is disclosed. It comprises: (a) a valve plate, which comprises a suction port, a displacement port, and a pressure build-up zone therebetween; (b) a valve cover, which is in close contact with the valve plate, comprises a suction port at a location corresponding to the suction port of the valve plate and a displacement port at a location corresponding to the displacement port of the valve plate; (c) a flow-diverted channel formed in the pressure build up zone of the valve plate; (d) a through hole provided in the bottom of the flow-diverted channel penetrating through the bottom part of the valve plate; (e) a guided channel formed in the valve cover at an interface between the cover and the valve plate abutting the through hole of the flow-diverted channel. The guided channel comprises a receptacle, which can be connected to the guided channel via the through hole, and an oil guided ditch which connects the receptacle with the second displacement port of the cover, whereby a spring-resisted seal device is provided in the receptacle of the guided channel of the valve cover the spring-resisted seal device is structured such that, under normal conditions, its spring force will push against and close the through hole of the valve plate, thus preventing the flow of fluid from the flow-diverted channel to the guided channel.

6 Claims, 7 Drawing Sheets

VALVE PLATE STRUCTURE OF AN AXIAL PLUNGER PUMP

BACKGROUND OF THE INVENTION

This invention relates to an improved valve plate structure for use in an axial plunger pump. It especially indicates an improved valve plate structure of the axial plunger pump type that can effectively reduce the overshootings and pressure pulses as well as reduce noise.

FIG. 1 shows the structure of a flow rate adjustable axial plunger pump. It mainly consists of a housing 1, a cylinder block 2, a plurality of plungers 3, an actuating yoke 4, a valve plate 5, and a cover 6. Among them, the cylinder block 2 has several compression cylinders 7 which are arranged around the circumference. They are to provide the plungers 3 with an opening for insertion and room to slide inside the cylinders. Also, the lower end of each of the plungers has a shoe 8 set up such that it can keep in sliding contact with the swash plate 9 of the actuating yoke and remain connected to the restrained plate 10.

When the transmission shaft 11 rotates, the cylinder block 2 also rotates together, because the transmission shaft is combined with the cylinder block by the splines and the plungers will rotate accordingly. Thereafter, the actuating yoke 4 can change its yoke angle by the joint action of the control piston block 12 and a compression-from-above spring 13. As the actuating yoke becomes inclined, the swash plate 9 and the restrained plate 10 will form an inclined angle accordingly. Thereby it will make the shoes 8 subject to the guided and restrained action of the swash plate 9 and the restrained plate 10 so as to bring the plungers 3 to generate reciprocating movement. This causes the compression cylinders' volume of the cylinder block to change, thus creating the oil suction and oil displacement actions. Also, as the yoke angle of the actuating yoke changes, the magnitude of the plunger's stroke will also change which causes the pump's flow rate to change accordingly.

In order to separate the oil suction and oil displacement of the cylinder block 2 and compression cylinder 7, there is a valve plate 5 set up at the opening side of the cylinder block 2 to control the open or closed state of the compression cylinder's opening 14 of the cylinder block 2 and to let each of plungers 3 and compression cylinders 7 rotate to all different angular positions so as to have access to the suction and displacement port located at the cover 6. In this way and to accompany the axial reciprocating action of the plungers 3, we can generate the cyclic actions of oil suction, compression and displacement while the compression cylinder 7 and plunger 3 rotate to various specific angular positions.

FIG. 2 and FIG. 3 show the structure of the conventional axial plunger pump's valve plate 5. On valve plate 5, there are a suction slot 15 and a plurality of displacement slots 16 which are set up in coordination with the rotational locus of the rotational compression cylinder's 7 opening 14 as well as the angle of plungers' suction, compression and displacement strokes. The suction slot 15 is accessible to the oil suction set up at cover 6 and its location and angle (as shown in angle A in FIG. 2) is the angle through which plungers 3 and compression cylinder 7 rotate during the suction stroke, thereby it can cause the fluid flow through the suction slot 15 and compression cylinder's 7 opening into the compression cylinder. The pressure build up zone 17 will be from the ending location of the suction slot 15 all the way to the beginning location of the displacement slot 16. The pressure build up zone is a dosed one and its range of angle (as shown in B angle in FIG. 2) is the compression stroke of plungers 3 and compression cylinder 7. The fluid inside the compression cylinder 7 is subject to a compression and is built up pressure when the compression cylinder rotates into this angular range. Thereafter, the compression cylinder 7 and plungers 3 rotate into the range of displacement slot 16 (C angle as shown in FIG. 2), and the compressed fluid inside the compression cylinder 7 can then displace through the slot 16 into the oil outlet at the cover 6 which generates the supply action of the pump.

When this kind of axial plunger pump is operating, the fluid is ejected through the outlet 14 of the compression cylinder for an instant which cause a sharp change of outlet pressure and creates a severe overshoot and pressure pulses of the pump which thereby create vibration and noise accordingly.

In order to eliminate this phenomenon, a v-notch 18 is set up on valve plate 5 in the pressure build up zone 17 before the displacement slot 16. The v-notch can divert part of the fluid inside the compression cylinder 7 into the displacement slot 16 soon after the pressure built up to a certain extent in the cylinder 7 which reduces the pressure difference between the cylinder 7 and displacement slot 16 and hence relieves the overshoot as well as cuts down the pressure pulses.

But still, this kind of v-notch set up on the valve plate 5 is not an effective way of eliminating the overshoot and pressure pulse. The pump vibration and noise remain rather high. Besides, the length and size of the v-notch must be in accordance with the pump pressure in order to create the optimum effect. One size of v-notch is suitable to a specific pressure. This kind of conventional valve plate structure is adaptable to those axial plunger pumps with constant pressure and not suitable for those with adjustable flow rates.

Also, this kind of custom-used v-notch valve plate structure will create a phenomenon that the fluid inside the compression cylinder 7 will sharply eject into the displacement slot 16, damaging the wall of the slot for a certain period of time. Besides, as the required accuracy of the shape and size of the v-notch is rather high and the shape is very complicated the machining work is very difficult.

Based on the foregoing reasons, there are a lot of shortcomings in the use of the conventional axial plunger pump. The inventor, with this consideration in mind, together with R & D experience in the relevant technology with constant testing and modification, eventually developed this improved valve plate structure.

SUMMARY OF THE INVENTION

The main purpose of this original undertaking is to provide an improved valve plate structure which can effectively reduce the overshoot and pressure pulse and is able to reduce the noise of an axial plunger pump.

Another purpose of this is to provide a kind of improved valve structure, which is simple in structural design and easy to manufacture, to be used in an axial plunger pump.

Yet another purpose of this original work is to provide a kind of improved valve structure, which can prevent the jet type of fluid flow as well as prevent damage to the displacement port, of an axial plunger pump.

In order to attain the foregoing purposes of improved works, the inventor would like to cite a practical example to explain the technical means, components and their efficacies and to accompany with illustrations as follows:

DETAILED DESCRIPTION OF THE INVENTION

Figure 1:
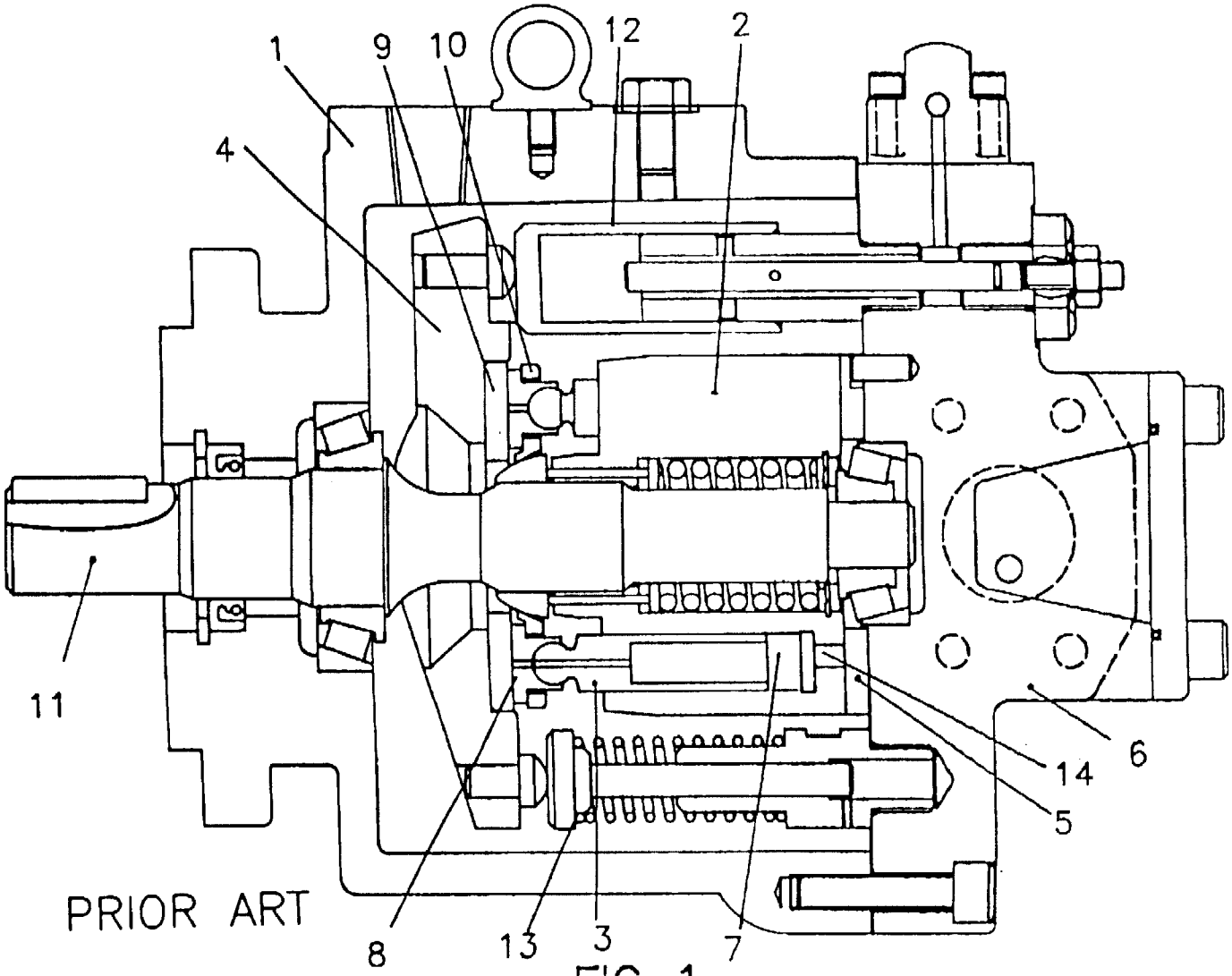
FIG 1 PRIOR ART
FIG. 1. The cross-section of a flow rate adjustable axial plunger pump.
Figure 2:
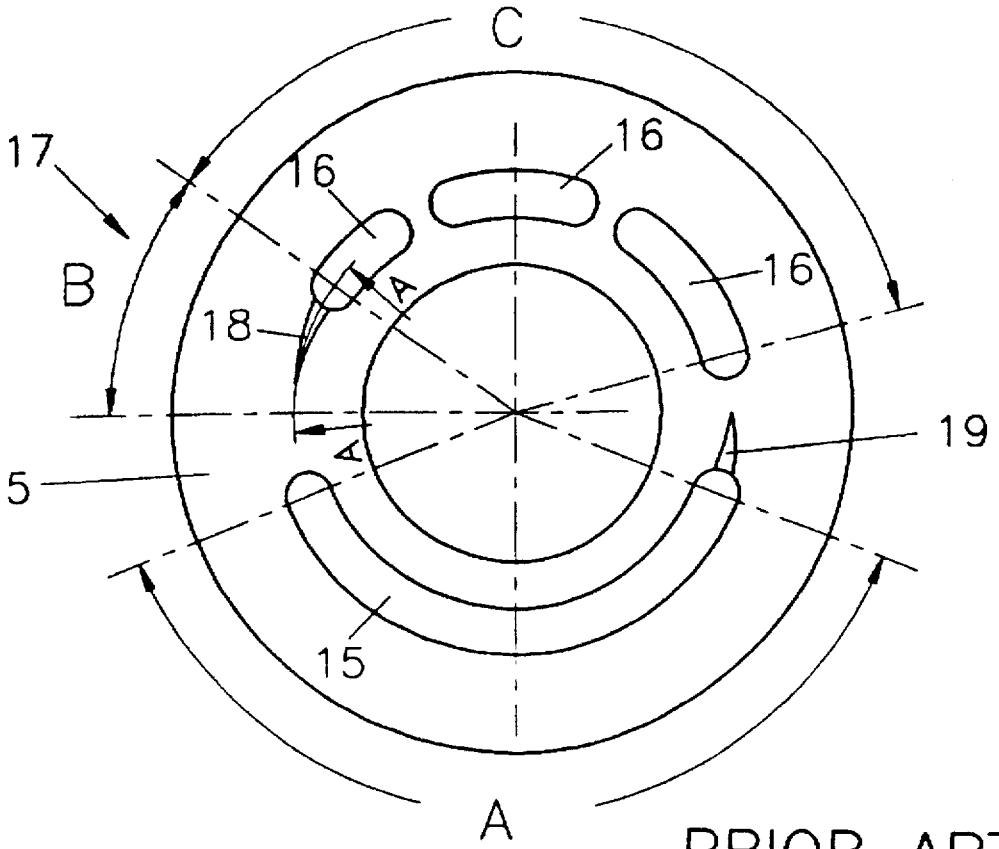
PRIOR ART FIG 2
FIG. 2. The top view of the valve plate of a conventional axial plunger pump.
Figure 3:
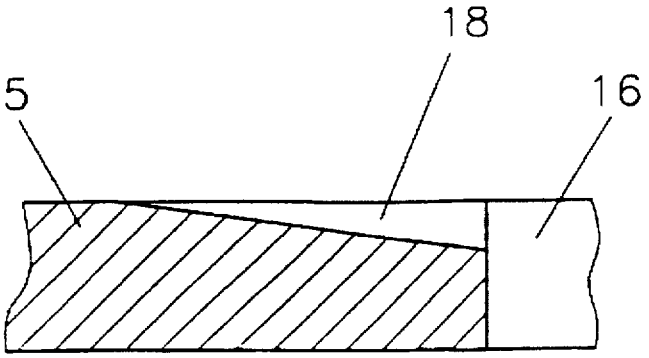
PRIOR ART FIG 3
FIG. 3. The cross-section view cut through section A—A in FIG. 2, to illustrate the v-notch shape of the axial plunger pump's valve plate.
Figure 4:
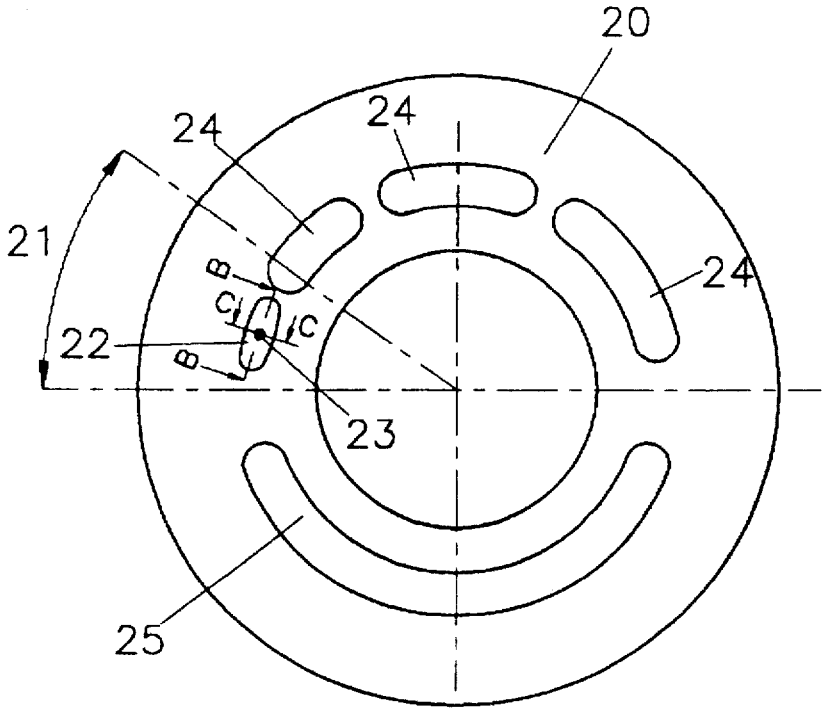
FIG. 4. The top view of the valve plate of the invention.

As shown in FIG. 4, this invention is mainly to establish, in the pressure build up zone 21 of the valve plate 20 of an axial plunger pump, a flow-diverted channel 22 and a hole 23 on the back side of the valve plate through which the bottom part of the channel 22 penetrates. Calling attention to FIG. 7, it also sets up, on the pump's cover 30 and the corresponding location of the flow-diverted channel 22, a guided channel 32 which can be connected to the oil drainage opening 31 of the pump. It also sets up, inside the guide channel 32, a reed 40 which can control the opened/closed state of hole 23 in valve plate 20. By use of the guided action of the flow-diverted channel 22, hole 23 and guided channel 32 as well as the control of the reed, the fluid in the compression cylinder of the axial plunger pump will be compressed to a certain pressure such that the fluid will push to open the reed 40 and flow through the guided channel 32 into the displacement port 31 set up on the cover 30 to attain the object of reducing the pressure difference between the displacement port and inside the compression cylinder, to lower the overshoot and pressure pulse.

Figure 5:
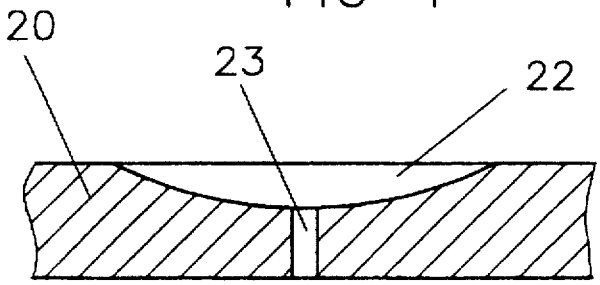
FIG. 5. The cross-section view through section B—B in FIG. 4, to disclose the structure of this invention.
Figure 6:
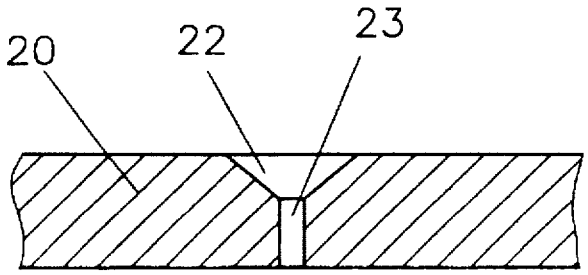
FIG. 6. The cross-section view through section C—C in FIG. 4.

FIG. 4, FIG. 5 and FIG. 6 show the valve plate 20 of this improvement over the conventional pump as well as the structure of its flow-diverted channel 22. The valve plate's pressure build up zone 21 does not have v-notch set up; rather, the flow-diverted channel is used instead. This flow-diverted channel, in general, is a long elliptical channel covering most of area of the pressure build up zone 21 through the length and there is a hole 23 set up in the center part. By use of the flow-diverted channel 22 and hole 23, it can direct fluid inside the compression cylinder, as the pump rotates into the angular range of the pressure build up zone, to flow through the cover 30 and into its guide channel 32. The shape of the flow-diverted channel 22 is very simple in structure, and the accuracy required for the dimension is not high, hence the manufacturing and machining is very easy. Besides, the flow-diverted channel 22 can be any shape and structure and is not limited to the long elliptical concave channel structure as shown in the figures.

Figure 7:
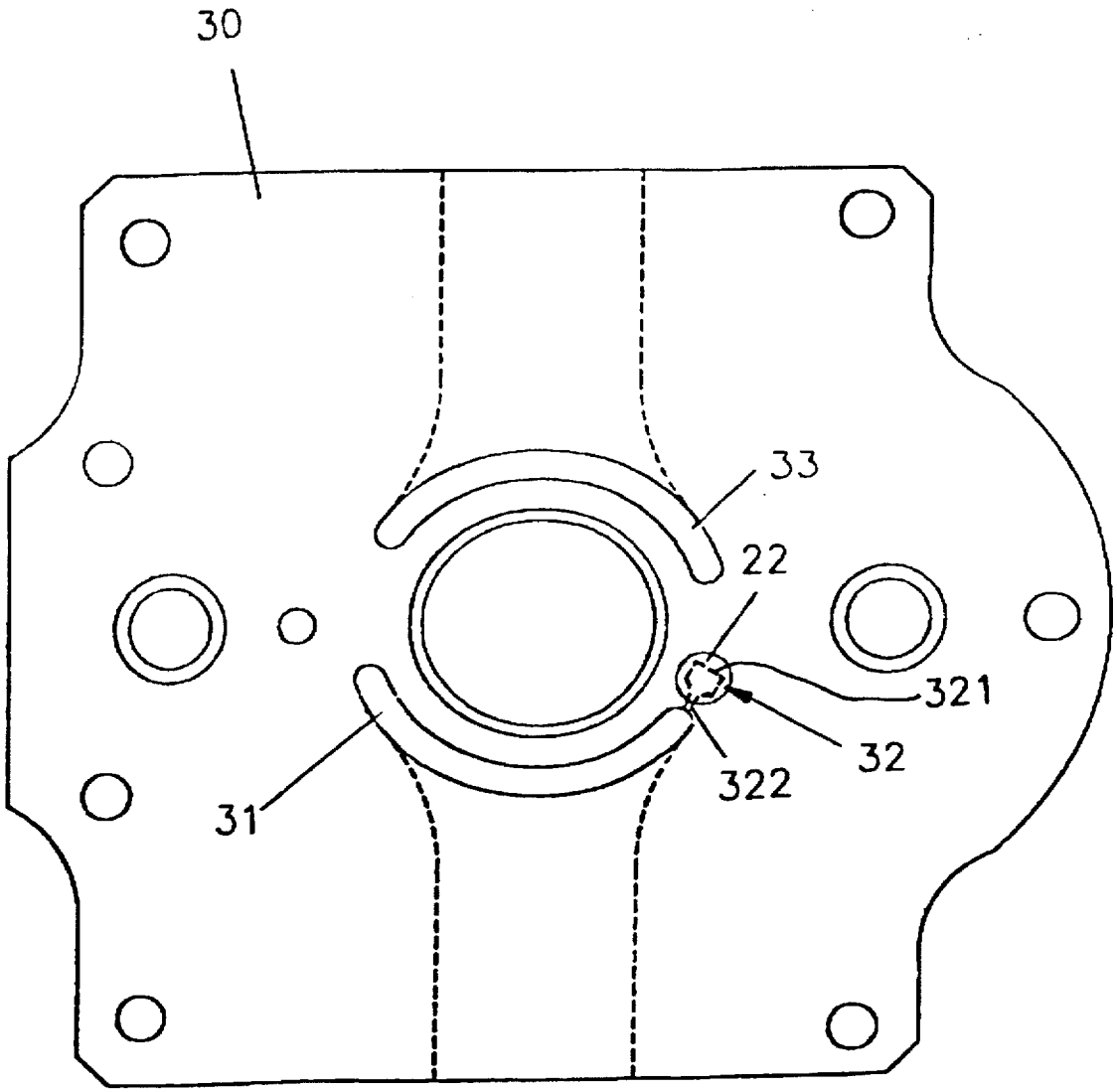
FIG. 7. The front view of the pump's side block.

As shown in FIG. 7, the guided channel 32 is established on the joint surface of the cover 30 and the valve plate 20 corresponding to the location of the valve plate's flow-diverted channel 22. See also FIG. 8, the guided channel 322 generally comprises a receptacle 321 to contain reed 40, and a long-narrow oil guided ditch 322 of the displacement port 31 to which the receptacle connects and passes. The receptacle 321 can be of any shape and dimension as long as it can match and contain the reed 40.

Figure 8:
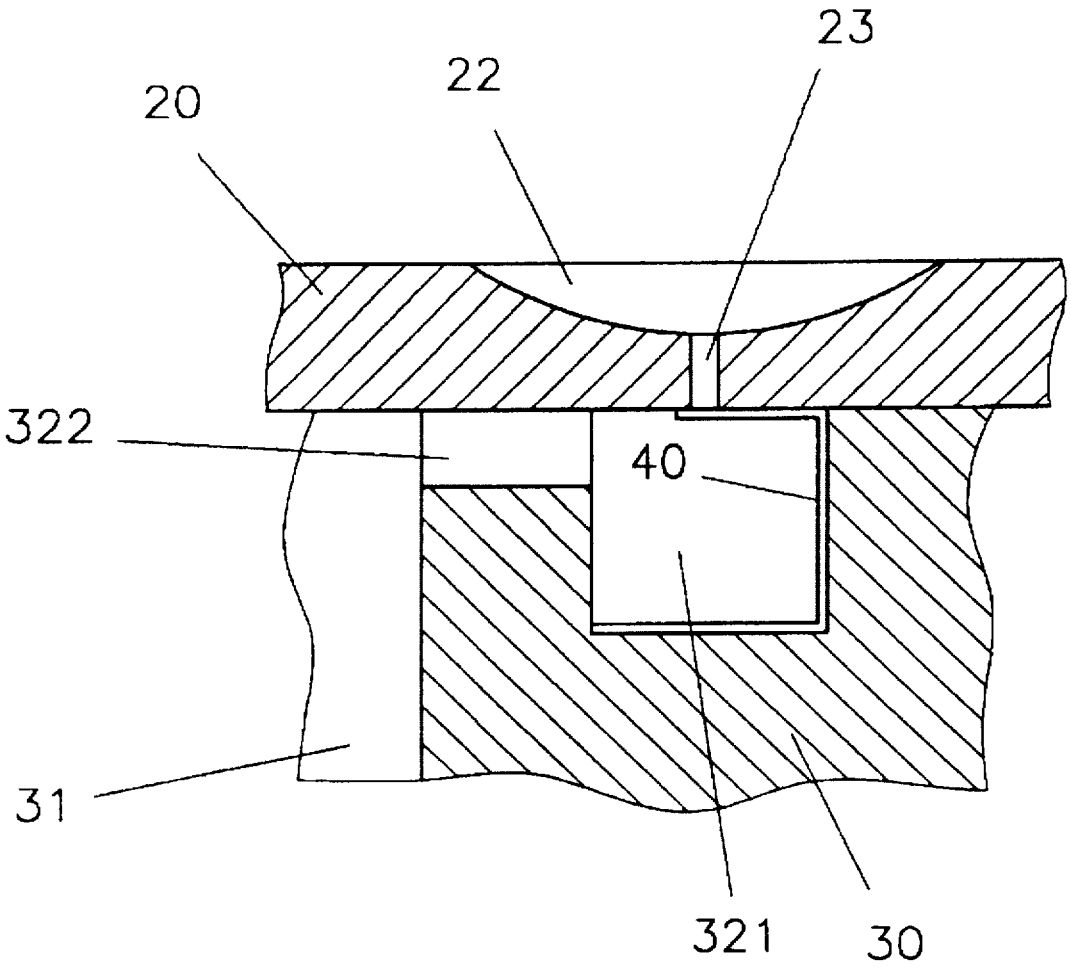
FIG. 8. A part of the cross-section of the valve plate flow-diverted channel together with the cover guided channel of this assembly to disclose their relative locations and the method of how the reed is installed.

As shown in FIG. 8, the receptacle 321 which contains a reed 40, can make use of that reed 40 to control the flow action of the fluid directed to the guided channel 322.

Figure 9:
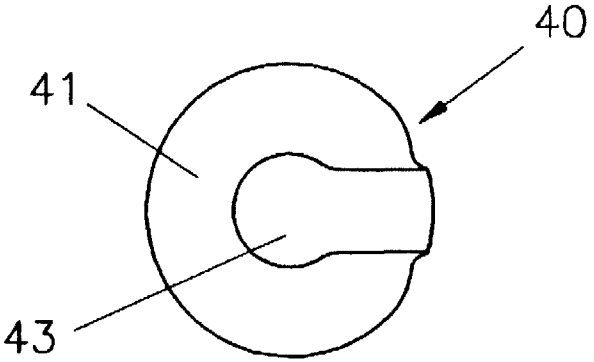
FIG. 9. The top view of the reed of this invention.
Figure 11:
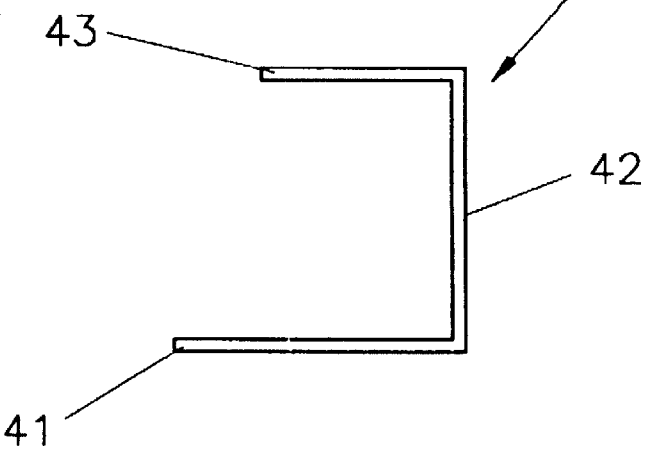
FIG. 11. The front view of the reed.
Figure 10:
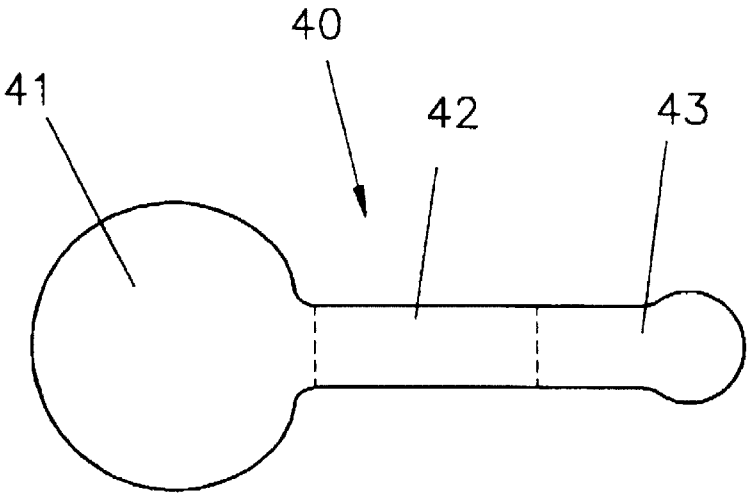
FIG. 10. The developed view of the reed.

As shown in FIG. 9, FIG. 10 and FIG. 11, the reed 40 is a sheet plate spring and is shape-pressed by a metal sheet plate. It has a bottom plate 41 which can sit on the bottom of the receptacle 321, a branch arm which is connected to the bottom plate 41, and a shield sheet 43 which is connected to the end of the branch arm 42. As the reed 40 places inside the receptacle 321, the round end of the shield plate 43 is exactly pressed against the bottom part of the valve plate and blocks up the hole 23 at the bottom of the valve plate 20, thereby the fluid is unable to flow into the guided channel 32. But as the fluid flows into the fluid-diverted channel 22 and the fluid pressure raises to a certain extent such that the push force of the fluid inside the hole 23 dominates the spring-resisted force of the shield sheet 43, the shield sheet will be pushed open and the fluid in the flow-diverted channel 22 can pass through the hole 23 and flow into the guided channel 32. Thereafter the fluid passes through the oil-guided ditch 322 and flow into displacement port 31 of the cover 30.

There are no special limitations as the dimension and shape of the reed 40 are concerned. The main factor to be considered is the magnitude of the spring force in design such that the push open force of the reed 40 is just right to attain the object of effectively reducing the overshoot and pressure pulse.

Figure 12:
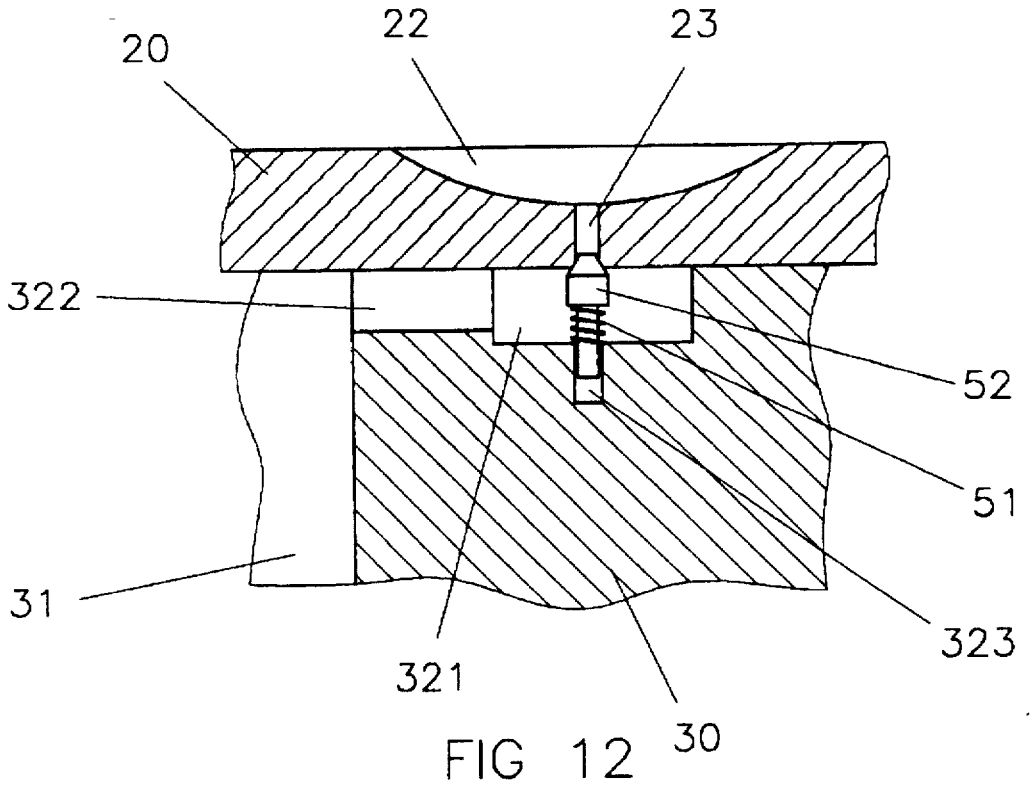
FIG. 12. An application of the spring-resisted sealed device.
Figure 13:
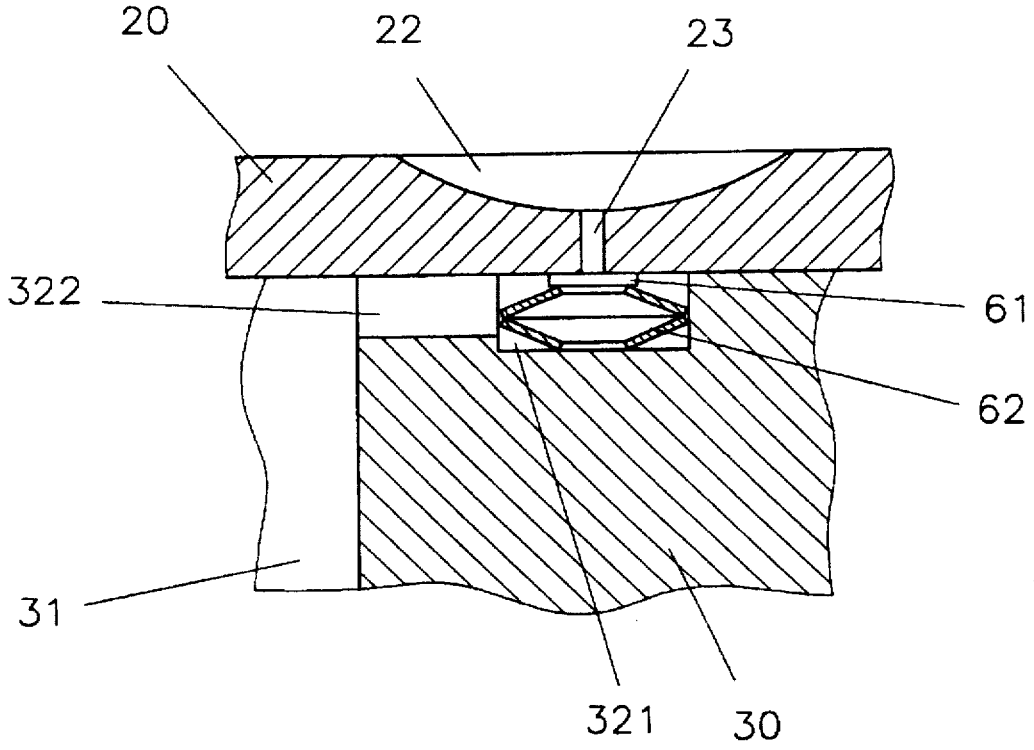
FIG. 13. Another application of the spring-resisted sealed device as suggested by this invention.

In addition, the structure of the reed 40 can be changed. As shown in FIG. 12, this original work makes use of a top-press spring 51 to accommodate a seal structure 61 to control the fluid flow into the guided channel 32. In this implementation example, the guided channel 32 has a guided hole set up to guide the seal structure 52 so that it can steadily perform the vertical, reciprocation movement. And the bottom edge of the hole 23 of the valve plate 20 is made in shape to tight fit that of the seal structure 52. As the fluid pressure of the flow-diverted channel 22 raises to a certain extent, it can then push open the seal structure 52 to let the fluid flows into the guided channel 32. Or, as shown in FIG. 13, the spring-resisted seal device can make use of several disk springs to control a seal structure 62 to attain the object of controlling the opened and closed condition of the hole 23.

This invention makes use of a flow-diverted channel 22, guided channel 32 and reed 40 to accommodate one another, not only can it effectively reduce the overshoot and pressure pulse of the pump, but, also it can greatly lower the operating noise. The structure and the shape of the valve plate of the present invention are so that the machining work required for manufacturing is very easy. Also, the way this improvement uses reed 40 to control the fluid flow from pressure build up zone into the oil drainage opening 31, it can perform well no matter how the pump pressure changes. It can improve the shortcomings of the conventional pump that it is applicable only in certain pressure range as the size of the v-notch of the axial plunger pump's valve plate is fixed. What is more, in the present invention, in the course the fluid in the pump's compression cylinder flows from the pressure build up zone into the displacement port 31, it will not damage the hole wall of the displacement port 31 since there is no jet flow phenomenon.

To summarize the foregoing statements, this original work, the improved valve plate structure of an axial plunger pump, can not only improve the shortcomings of the custom-used valve plate structure of the axial plunger pump, but also it is simple in structure and easy to perform machining, and its practicalities are out of questions. Besides, the technical contents of this original work are not found in the custom-used applications, and the fact that it can promote the efficacies, meets the requirements of up-to-date and progressiveness, and makes the inventor files this application according the patent law. But the forgoing cited examples are only some of the best implemented practices and they must not be seen as the only embodiments of this invention. That is, the various design changes which are done by the following claims will belong to the range of this case of patent application.

What is claimed is:

1. A valve plate structure for use in an axial plunger pump comprising:

a valve plate, which comprises a first suction port, a first displacement port, and a pressure build-up zone therebetween;

a cover, which is in close contact with a rear side of said valve plate, comprises a second suction port at a location corresponding to said first suction port of said valve plate and a second displacement port at a location corresponding to said first displacement port of said valve plate;

a flow-diverted channel formed in said pressure build up zone of said valve plate;

a through hole provided in a bottom of said flow-diverted channel penetrating through a bottom part of said valve plate;

a guided channel formed in said cover at an interface between said cover and said valve plate abutting said through hole of said flow-diverted channel, said guided channel comprises a receptacle, which can be connected to said flow-diverted channel via said through hole, and an oil guided ditch, which connects said receptacle with said second displacement port of said cover; and a spring-resisted seal device provided in said receptacle of said guided channel, said spring-resisted seal device is structured such that, under normal conditions, its spring force will push against and close said through hole of said valve plate, thus preventing a flow of a fluid from said flow-diverted channel to said guided channel;

said spring-resisted seal device is further structured such that, when a pressure in said through hole dominates said spring force, said spring-resisted seal device will be pushed open, thus allowing fluid to flow from said flow-diverted channel to said guided channel, through said oil guided ditch and to said second displacement port of said cover, to thereby allowing said second displacement port to build up pressure in advance so as to reduce an overshoot and pressure pulses.

2. The valve plate structure for use in an axial plunger pump as claimed in claim 1, wherein the spring-resisted seal device comprises a reed made of a sheet metal including a shield sheet portion for sealing said through hole of the said valve plate.

3. The valve plate structure for use in an axial plunger pump as claimed in claim 1, wherein said spring-resisted seal device comprises a sealing structure to close said hole of the valve plate, and a spring force structure for pushing said seal structure against thus sealing said through hole of the valve plate.

4. The valve plate structure for use in an axial plunger pump as claimed in claim 3, wherein the spring force structure is a compression spring.

5. The valve plate structure for use in an axial plunger pump as claimed in claim 3, wherein the spring force structure comprises a plurality of disk springs.

6. The valve plate structure for use in an axial plunger pump as claimed in claim 1, wherein said valve plate is structured to accommodate a plurality of compression cylinders in a cylinder block of an axial plunger pump and control suctions and displacements of the compression cylinders, said valve plate further comprises a plurality of pairs of said first suction port and said first displace port arranged within an angle of displacement stroke so as to accommodate the suction and displacement of each respective compression cylinder of the cylinder block.

* * * * *